US007001663B2

(12) United States Patent
Breuer

(10) Patent No.: US 7,001,663 B2
(45) Date of Patent: Feb. 21, 2006

(54) MONOFILAMENT OF POLYAMIDE, FLAT TEXTILE PRODUCT AND METHOD FOR PRODUCING SAME

(75) Inventor: Hans-Peter Breuer, Zell (DE)

(73) Assignee: Albany International Corp., Albany, NY (US)

( * ) Notice: Subject to any disclaimer, the term of this patent is extended or adjusted under 35 U.S.C. 154(b) by 0 days.

(21) Appl. No.: 10/479,125

(22) PCT Filed: Jun. 13, 2002

(86) PCT No.: PCT/US02/18896

§ 371 (c)(1),
(2), (4) Date: Jul. 23, 2004

(87) PCT Pub. No.: WO03/000742

PCT Pub. Date: Jan. 3, 2003

(65) Prior Publication Data

US 2004/0241438 A1 Dec. 2, 2004

(51) Int. Cl.
*D01F 6/00* (2006.01)

(52) U.S. Cl. ..... 428/364; 428/395

(58) Field of Classification Search ..... 428/364, 428/395; 525/420
See application file for complete search history.

(56) References Cited

U.S. PATENT DOCUMENTS

| | | | | |
|---|---|---|---|---|
| 3,930,098 | A | 12/1975 | Araki et al. | |
| 4,072,792 | A | 2/1978 | Araki et al. | 442/394 |
| 4,291,142 | A * | 9/1981 | Tamura et al. | 525/420 |
| 4,348,502 | A | 9/1982 | Coran et al. | 525/183 |
| 4,421,819 | A | 12/1983 | Baker | 442/181 |
| 4,575,437 | A * | 3/1986 | Kojima et al. | 264/1.27 |
| 4,853,164 | A * | 8/1989 | Kiang et al. | 264/470 |
| 5,139,873 | A | 8/1992 | Rebouillat | 428/375 |
| 5,391,419 | A | 2/1995 | Davenport | 428/193 |
| 5,502,120 | A | 3/1996 | Bhatt et al. | 525/440 |
| 5,829,488 | A | 11/1998 | Fagerholm et al. | 139/383 |
| 5,869,180 | A | 2/1999 | Budenbender et al. | 428/373 |
| 5,998,551 | A | 12/1999 | O'Neil et al. | 525/426 |
| 6,189,577 | B1 | 2/2001 | Lee | 139/383 A |

FOREIGN PATENT DOCUMENTS

| | | |
|---|---|---|
| EP | 0 145 378 | 6/1985 |
| JP | 60-42254 | 3/1985 |
| WO | WO 86/05739 | 10/1986 |
| WO | WO 98/55171 | 12/1998 |

* cited by examiner

*Primary Examiner*—N. Edwards
(74) *Attorney, Agent, or Firm*—Frommer Lawrence & Haug LLP; Ronald R. Santucci

(57) ABSTRACT

The invention relates to a monofilament of polyamide, especially for flat textile products, for use in paper machines, for instance, as well as a flat textile product and a method for producing same.

7 Claims, 3 Drawing Sheets

MONOFILAMENT OF POLYAMIDE, FLAT TEXTILE PRODUCT AND METHOD FOR PRODUCING SAME

Figure 1:
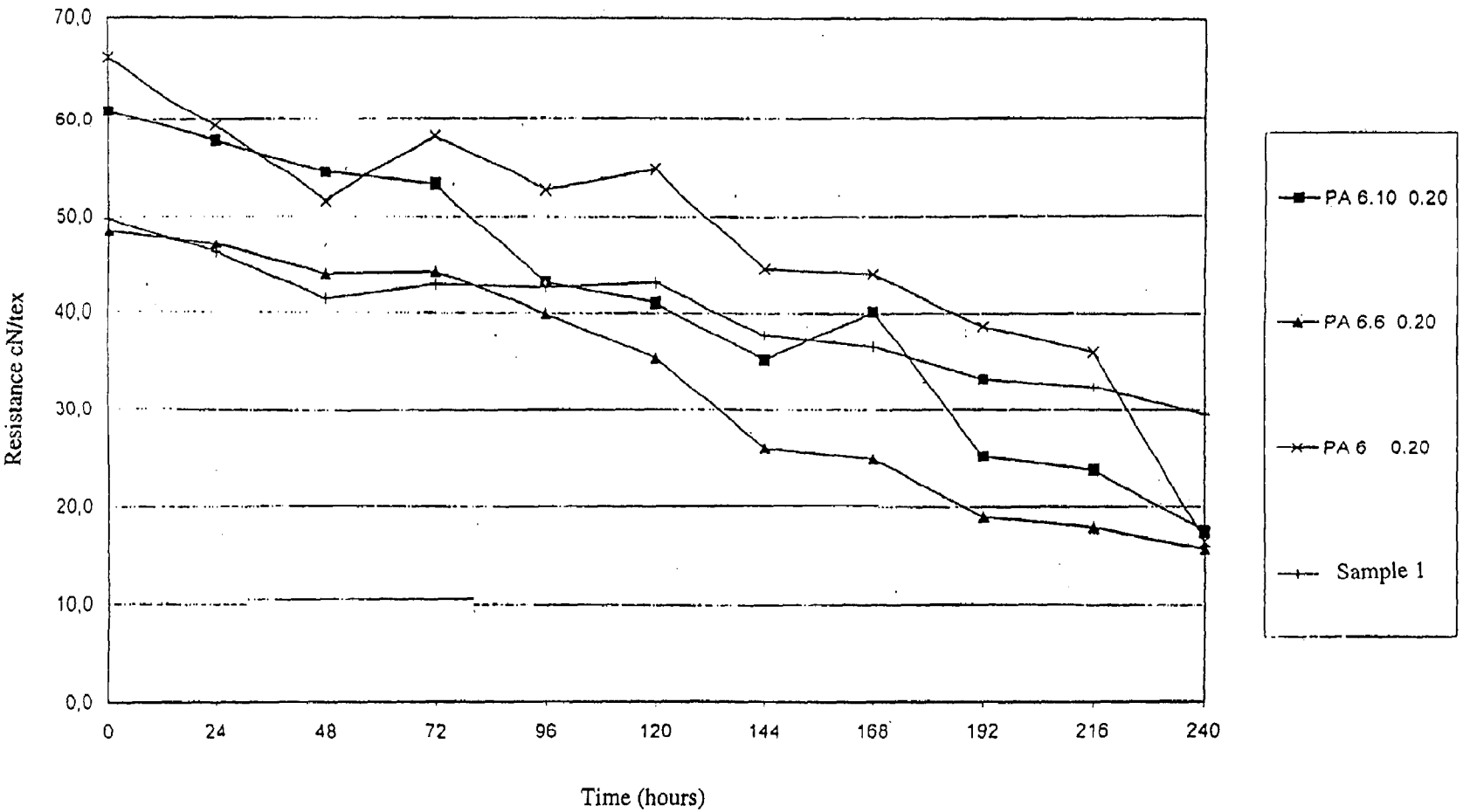

This application is a 371 of International Patent Application No. PCT/US02/18896 filed Jun. 13, 2002, now WO 03/000742 A1 published Jan. 3, 2003 and which claims priority benefits from German patent application number DE 101 317 29.8 filed Jun. 21, 2001.

The invention relates to a monofilament of polyamide, especially for flat textile products, for use in paper machines, for instance, as well as a flat textile product, a method for producing same and the use of a method for producing a flat textile product.

Among other uses, such flat products are used as paper machine covers, e.g., as press felts. Press felts are conducted with the still moist paper web or cellulose web over rolls and through a series of roll pairs and water is removed from the moist web during this passage. The press felt serves not only as a carrying surface for the moist web, but also to absorb the water pressed out of the web. The water accumulating in the conveyor belt-like press felt is removed by dewatering devices, positioned for instance at a point where the paper web is no longer in direct contact with the press felt.

After the mechanical dewatering section, the paper web is transferred to a drying section where it is essentially subjected to thermal treatment, and is thereby further dewatered or dried.

In the drying section, monofilaments with strong thermal resistance, such as PPS, PCTA and stabilized PETP, are primarily used for the paper machine covers.

In the press section of the paper machine, on the other hand, emphasis is placed on the mechanical strength of the monofilaments used for the covers. In this section, therefore, polyamides such as, for instance, PA 6, PA 6.6, PA 6.10 and PA 6.12 are used, because they have very good strength, especially under continuous, sustained mechanical strains.

The disadvantage of such a cover lies in the fact that the polymers used are highly hygroscopic, meaning that they have a high water absorption capacity. The water diffuses mainly through the amorphous regions of the partially crystalline polyamide and so causes the threads to swell. This swelling, known as hygral expansion, is disadvantageous especially with regard to the dimensional stability of the final product.

In addition to the hygral expansion, moreover, the water absorption also causes the polyamides to age more rapidly. Their mechanical properties deteriorate over the course of time because the water penetrates through the amorphous regions into the crystalline regions and remains lodged between the molecular chains. As a result, the distances between the molecules are widened and the hydrogen bridge linkages responsible for the mechanical properties are weakened. Consequently, the monofilaments PA 6, PA 6.6, PA 6.10 or PA 6.12 become more brittle and prone to splitting over the course of time.

Furthermore, the patent EP 0 784 107 A2 discloses a method for producing a monofilament which contains, in addition to the polyamide, also a maleic anhydride-modified polyethylene/polypropylene rubber at the rate of 1% to 30% by weight, and anti-aging stabilizers at the rate of up to 3% by weight. This is supposed to improve the abrasion resistance and form stability of the industrial use flat product.

By means of this measure, hydrophobic properties are given to the polyamide. And yet, due to the contradictory properties of the polymers used, such a polyamide is difficult and expensive to produce.

A cross-linked polyamide block polymer is known from the patents U.S. Pat. No. 5,998,551 and JP-A 81 12 052. A method for producing very strong fibers is known from the patent U.S. Pat. No. 4,853,164. A paper machine fabric made of polyethylene is known from U.S. Pat. No. 4,421,819. A method for producing very strong polyethylene fibers is known from the patent U.S. Pat. No. 4,778,663.

The objective of the present invention is to propose a monofilament of polyamide which features improved mechanical properties, especially with regard to abrasion, strength and proneness to splitting, but also with regard to the modification of properties over the course of time. It is also the objective of the invention to propose a flat textile product, especially a forming wire or press felt, for use in cellulose fiber preparation or paper production, for instance, and a method for producing such a flat textile product.

Under the present invention, the objective is attained by a monofilament of the type mentioned in the beginning, containing polyamide at the rate of 99.9% to 90% by weight, and a cross-linkage reinforcement agent at the rate of 0.1% to 10% by weight, the polyamide being at least partially cross-linked. The polyamide is a meltable, spinnable, thread-forming polyamide.

Such a monofilament possesses the advantage that the molecule chains are bound to each other more closely and strongly as a result of the cross-linkage, which causes the formation of covalent bonds, thereby preventing the infiltration of water molecules between the molecule chains through the amorphous regions. Consequently, the hydrogen bridge linkages are no longer widened or loosened.

The deterioration of the mechanical properties resulting as an-aging effect from the absorption of water can therefore be greatly reduced. Finally, the mechanical properties of the filament are also improved. Thus, the invention-specific monofilaments display, for instance, less abrasion and less inclination to splitting.

In particular, the invention provides that the cross-linkage of the monofilaments is not limited to their border regions, but extends across the entire cross-section of the monofilament. In this regard, it is advantageous if no core/mantle effects are observed, of the kind, for instance, that can occur as a result of chemical cross-linkage.

In particular, the invention provides that the monofilament contains a crosslinkage reinforcement agent at the rate of 0.5% to 5% by weight and in particular preferably a cross-linkage reinforcement agent at the rate of 1% to 3% by weight. As the reinforcement agent, TAIC (triallyl isocyanurate) or TAC can be used, for instance. TAIC can be purchased in the market under the name 'Beta Link Master' from a number of companies, among them Plastic Technology Service Marketing-und Vertriebs GmbH, Adelshofen.

In particular, the invention provides that only a partial cross-linkage is effected, because a complete cross-linkage would cause the threads to become brittle.

As the polyamide, PA 6 or PA 6.6 or mixtures of the two can be used. But other polyamides or mixtures with or made of other polyamides can also be used.

The invention also relates to a flat textile product, especially a forming wire or press felt, for use in cellulose fiber preparation or paper production, for instance, in which at least the warp threads consist of monofilaments having the properties described above. The warp thread, which runs in the transverse direction in the finished, possibly endlessly woven felt, is responsible in particular for the dimensional stability of the fabric.

Finally, the invention also relates to a method for producing flat textile products comprising monofilaments with the properties described above, in which the monofilament is extruded and subsequently drawn and woven, the monofilaments being mixed with a cross-linkage reinforcement agent prior to extrusion and irradiated with electron rays before and/or after the weaving process, by means of which the polyamides are partially cross-linked.

As compared to chemical cross-linking, the use of electron radiation to effect the cross-linkage entails the advantage that no core/mantle effects are produced, i.e., the monofilaments are cross-linked across their entire cross section and not only in the border region (mantle). The electron rays penetrate the entire monofilament, so that cross-linkage also occurs in the core region.

It is also possible to irradiate the complete fabric, thus the fabric as a whole, or only sections of the fabric, this latter option being useful for achieving certain effects in the fabric.

Under an execution example, the irradiation should be performed at 0.1 to 100 kGy, in particular at 10 to 60 kGy and in particular at 15 to 30 kGy.

Further execution forms of the invention are disclosed in the other application materials.

In several trials, the invention-specific monofilament was subjected to various different treatments, which are described below. In the first trial, the values of the first sample were recorded without activator and before irradiation, and in the second trial, the values of the first sample were recorded without activator and after irradiation. In the third trial, the values of the second sample were calculated with activator before irradiation and in the fourth trial the values of the second sample were calculated with activator after irradiation, all of which can be seen in Table 1. Table 1 makes it clear that the threads were not damaged by the irradiation.

Figure 2:
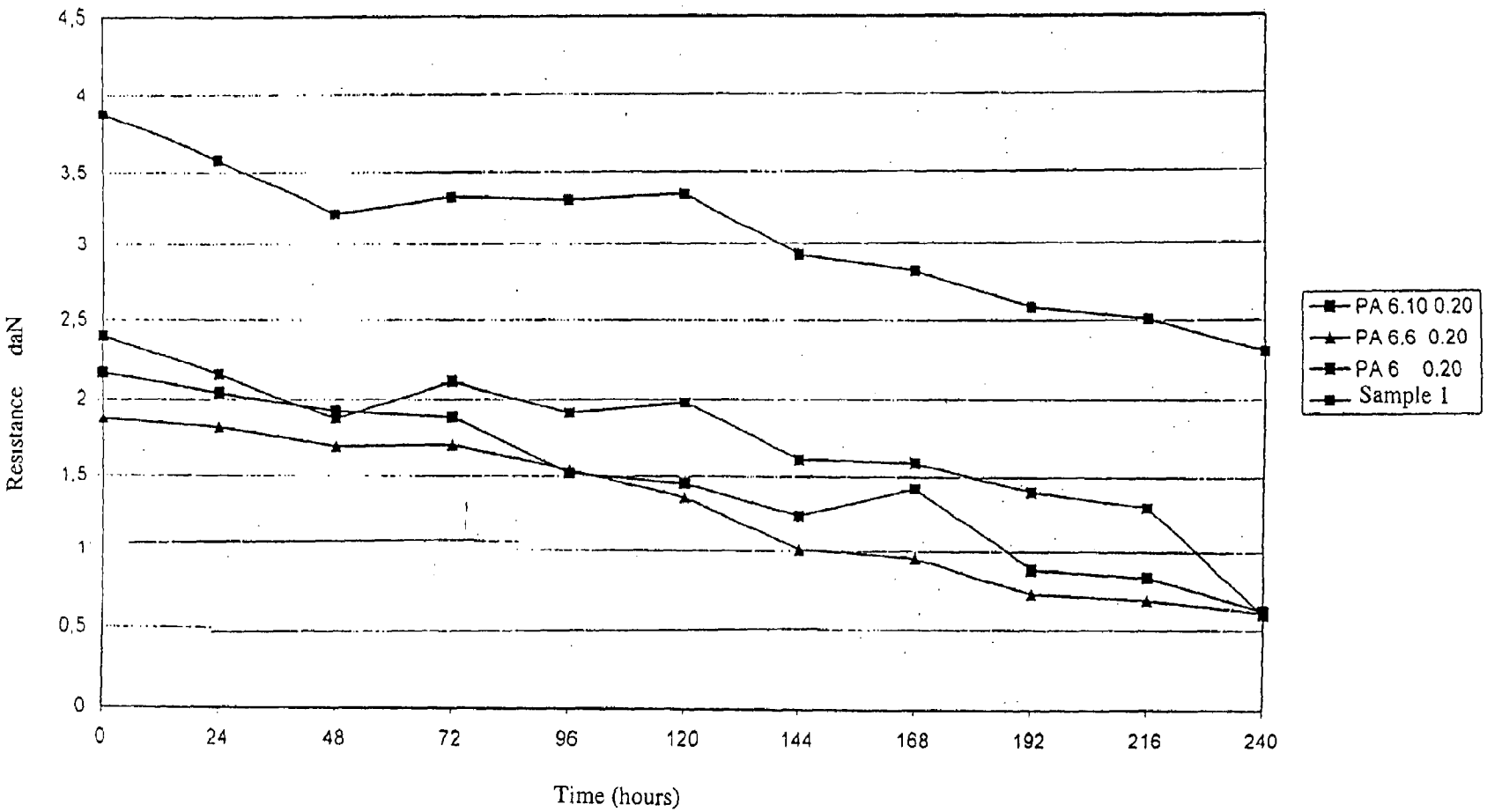
Figure 3:
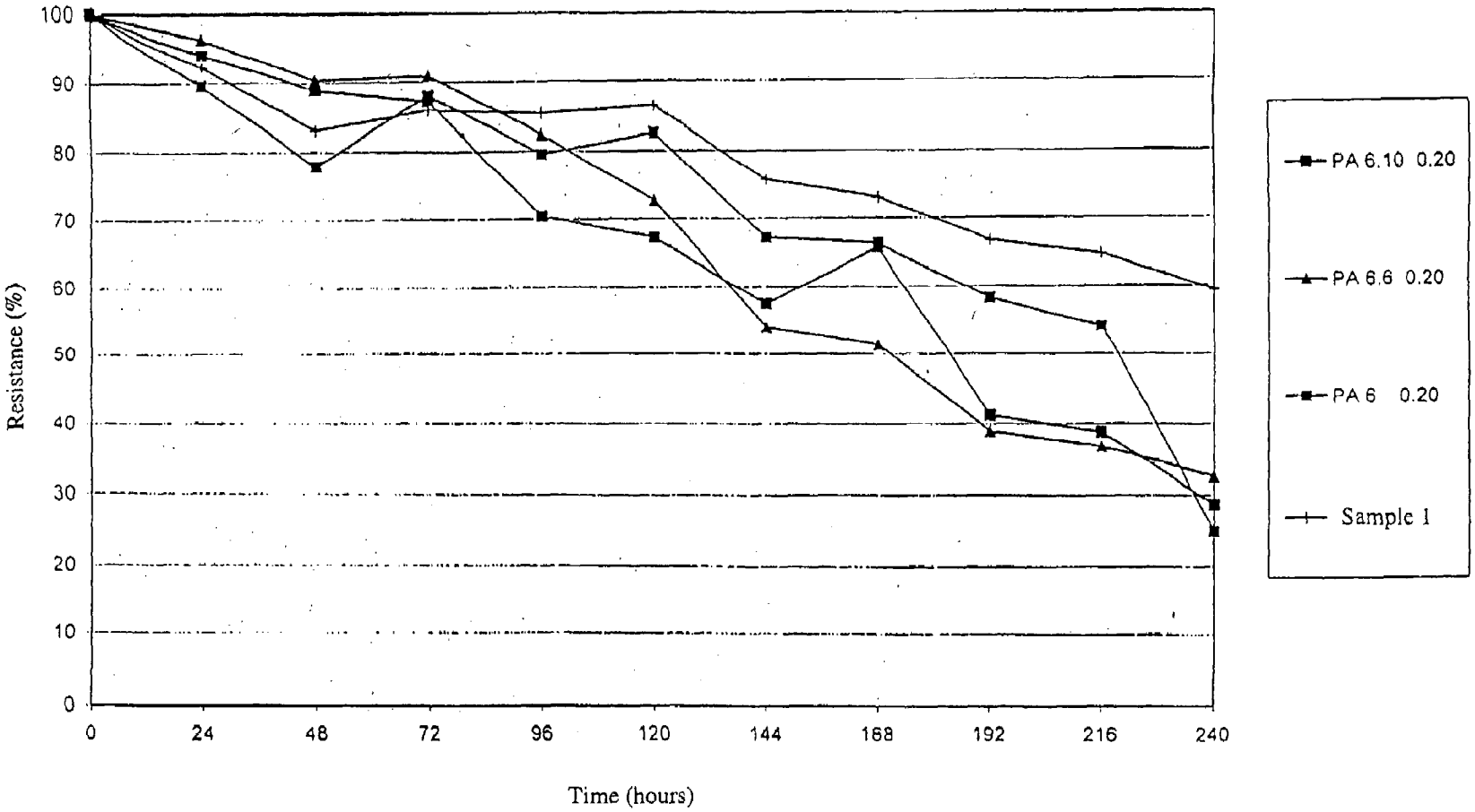

FIGS. 1 through 3 describe a further trial in which different polyamide samples were subjected to a hydrolysis test in an autoclave over a time period of 240 hours at 120° C. in saturated steam. In this trial, it was clearly shown (FIGS. 1 through 3) that the tensile force of the sample with activator after irradiation declined much less sharply than in the other samples. The tensile force reduction is a measure of chemical damage, caused for instance by longitudinal cracks or by deformation to a polygon. Furthermore, the shrinkages are less than in the samples without activator. Remarkably, the hygral expansion is unchanged and the diameter modification in the sample with activator is much less than in the sample without activator. The cracking resistance of the invention-specific monofilament declined much less sharply. Here too, the gradient is a measure of the damage to the monofilament. The gradient of cracking resistance change is less than in the known monofilaments. In this trial, 10 samples were produced of all materials. All samples were removed after 24 hours and tested for strength.

TABLE 1

| Sample | | Without Activator | | With Activator | |
|---|---|---|---|---|---|
| Irradiation | | Before | After | Before | After |
| Maximum Tensile Force | daN | 4.2 | 3.8 | 3.9 | 3.8 |
| Specific Maximum Tensile Force | cN/dtex | 5.4 | 4.8 | 4.8 | 4.7 |
| Maximum Tensile Force Extension | % | 25.3 | 24 | 19.8 | 18 |
| Testrite Shrinkage | % | 8.2 | 7.1 | 9.4 | 8.4 |
| Boiling Shrinkage | % | 7.8 | 6.4 | 9.3 | 8.3 |

TABLE 1-continued

| Sample | | Without Activator | | With Activator | |
|---|---|---|---|---|---|
| Irradiation | | Before | After | Before | After |
| Hygral Expansion | % | 2.1 | 1.7 | 2.1 | 2.1 |
| Diameter | tex | 77.3 | 76.8 | 81.3 | 81.1 |

TABLE FOR FIG. 1
Indication of Cracking Resistance in cN/tex

| Time (hours) | PA 6.10 0.20 | PA 6.6 0.20 | PA 6 0.20 | Sample 1 |
|---|---|---|---|---|
| 0 (New) | 61.0 | 48.4 | 66.1 | 49.7 |
| 24 | 57.6 | 46.9 | 59.2 | 46.0 |
| 48 | 54.2 | 43.8 | 51.5 | 41.3 |
| 72 | 53.1 | 44.0 | 58.1 | 42.7 |
| 96 | 42.9 | 39.9 | 52.6 | 42.4 |
| 120 | 41.0 | 35.2 | 54.5 | 42.9 |
| 144 | 35.0 | 26.2 | 44.4 | 37.7 |
| 168 | 40.1 | 24.9 | 43.8 | 36.4 |
| 192 | 25.1 | 18.9 | 38.6 | 33.2 |
| 216 | 23.7 | 17.9 | 35.8 | 32.3 |
| 240 | 17.5 | 15.8 | 16.5 | 29.6 |

TABLE FOR FIG. 2
Indicator for Cracking Resistance in daN

| Time (hours) | PA 6.10 0.20 | PA 6.6 0.20 | PA 6 0.20 | Sample 1 |
|---|---|---|---|---|
| 0 (New) | 2.16 | 1.87 | 2.40 | 3.87 |
| 24 | 2.04 | 1.81 | 2.15 | 3.58 |
| 48 | 1.92 | 1.69 | 1.87 | 3.21 |
| 72 | 1.88 | 1.70 | 2.11 | 3.32 |
| 96 | 1.52 | 1.54 | 1.91 | 3.30 |
| 120 | 1.45 | 1.36 | 1.98 | 3.34 |
| 144 | 1.24 | 1.01 | 1.61 | 2.93 |
| 168 | 1.42 | 0.96 | 1.59 | 2.83 |
| 192 | 0.89 | 0.73 | 1.40 | 2.58 |
| 216 | 0.84 | 0.69 | 1.30 | 2.51 |
| 240 | 0.62 | 0.61 | 0.60 | 2.30 |

| 35.4 tex | 38.6 tex | 36.3 tex | 77.8 tex |
|---|---|---|---|

TABLE FOR FIG. 3
Indication of Cracking Resistance in %
(starting from absolute starting value of each material)

| Time (hours) | PA 6.10 0.20 | PA 6.6 0.20 | PA 6 0.20 | Sample 1 |
|---|---|---|---|---|
| 0 (New) | 100 | 100 | 100 | 100 |
| 24 | 94.4 | 96.8 | 89.6 | 92.5 |
| 48 | 88.9 | 90.4 | 77.9 | 82.9 |
| 72 | 87.0 | 90.9 | 87.9 | 85.8 |
| 96 | 70.4 | 82.4 | 79.6 | 85.3 |
| 120 | 67.1 | 72.7 | 82.5 | 86.3 |
| 144 | 57.4 | 54.0 | 67.1 | 75.7 |
| 168 | 65.7 | 51.3 | 66.3 | 73.1 |
| 192 | 41.2 | 39.0 | 58.3 | 66.7 |
| 216 | 38.9 | 36.9 | 54.2 | 64.9 |
| 240 | 28.7 | 32.6 | 25.0 | 59.4 |

What is claimed is:

1. A monofilament of non-aromatic polyamide wherein the monofilament contains non-aromatic polyamide at the rate of 99.9% to 90% by weight and a cross-linkage reinforcement agent at the rate of 0.1% to 10% by weight and in that the non-aromatic polyamides are partially cross-linked.

2. The monofilament according to claim 1, wherein the monofilament contains 0.5% to 5% by weight of a cross-linkage reinforcement agent.

3. The monofilament according to claim 1, wherein the monofilament contains 1% to 3% by weight of a cross-linkage reinforcement agent.

4. The monofilament according to claim 1, wherein the cross-linkage reinforcement agent is TAIC (triallyl isocyanurate) or TAC.

5. The monofilament according to claim 1, wherein the monofilament is cross-linked across its entire cross section.

6. The monofilament according to claim 1, wherein essentially amorphous regions of the non-aromatic polyamides are cross-linked.

7. The monofilament according to claim 1, wherein the non-aromatic polyamide is a PA 6, PA 6.6, PA 6.10 or PA 6.12.

* * * * *